US009038292B2

(12) United States Patent
Lynch

(10) Patent No.: US 9,038,292 B2
(45) Date of Patent: May 26, 2015

(54) DISPLAY TOOL

(71) Applicant: SAMPLING INTERNATIONAL, LLC, Lake Forest, CA (US)

(72) Inventor: Anthony James Lynch, Lake Forest, CA (US)

( * ) Notice: Subject to any disclaimer, the term of this patent is extended or adjusted under 35 U.S.C. 154(b) by 0 days.

(21) Appl. No.: 14/108,221

(22) Filed: Dec. 16, 2013

(65) Prior Publication Data

US 2014/0165434 A1 Jun. 19, 2014

Related U.S. Application Data

(60) Provisional application No. 61/738,222, filed on Dec. 17, 2012.

(51) Int. Cl.

| | |
|---|---|
| ***G09F 1/00*** | (2006.01) |
| ***G09F 5/00*** | (2006.01) |
| *G09F 5/04* | (2006.01) |

(52) U.S. Cl.

CPC ..... *G09F 5/00* (2013.01); *G09F 2005/048* (2013.01); *G09F 5/04* (2013.01)

(58) Field of Classification Search

CPC ..... G09F 5/00; G09F 2005/048; G09F 5/02; G09F 5/04; G09F 2005/045; G09F 2005/047

USPC ..... 40/124.13, 124.08

See application file for complete search history.

(56) References Cited

U.S. PATENT DOCUMENTS

| | | | | |
|---|---|---|---|---|
| 817,209 | A | | 4/1906 | Williams |
| 2,707,839 | A | | 5/1955 | Green, Jr. |
| 2,795,059 | A | | 6/1957 | Mendelsohn |
| 2,824,394 | A | * | 2/1958 | Lohnes ..... 40/124.13 |
| 3,008,248 | A | * | 11/1961 | Steinthal ..... 206/472 |
| 3,514,875 | A | | 6/1970 | Howard |
| 3,631,975 | A | | 1/1972 | Leibowitz |
| 3,776,503 | A | | 12/1973 | Boden et al. |
| 4,365,355 | A | | 12/1982 | Off et al. |
| 4,433,883 | A | | 2/1984 | Boender et al. |
| 4,456,122 | A | | 6/1984 | Kalal |
| 4,458,435 | A | | 7/1984 | Ackerman |
| D284,435 | S | | 7/1986 | Zelenko et al. |
| 4,636,037 | A | | 1/1987 | Thomke et al. |
| 4,721,638 | A | | 1/1988 | Matsuguchi et al. |
| 4,756,693 | A | | 7/1988 | Matsuno et al. |
| 4,848,855 | A | | 7/1989 | Cone et al. |

(Continued)

OTHER PUBLICATIONS

International Search Report dated Jun. 24, 2014 from corresponding international application PCT/US2013/075592 fromf (attached) from Korean Intellectual Property Office, Officer Kim, Jin Ho (tel. 82-42-48-8699).

*Primary Examiner* — Kristina Junge

(74) *Attorney, Agent, or Firm* — Plager Schack LLP

(57) ABSTRACT

A display tool is configured to maneuver a fabric swatch covering and includes a swatch deck and a support arm attached to a lifting tab to maneuver the lifting tab away from the swatch deck. A substrate is attached to the swatch deck and configured to support the support arm when the lifting tab is distant the swatch deck. A first swatch covering front side is attached to the support arm. A first plurality of support veins front side is attached to the first swatch covering back side and the first plurality of support veins back side is attached to the substrate. The support arm can be supported against the substrate to display the first swatch covering and the first plurality of support veins from the support arm.

3 Claims, 2 Drawing Sheets

(56) References Cited

U.S. PATENT DOCUMENTS

| | | | |
|---|---|---|---|
| 5,031,781 | A | 7/1991 | Price et al. |
| 5,050,747 | A | 9/1991 | Krautsack |
| 5,370,024 | A | 12/1994 | Lerner et al. |
| 5,647,485 | A | 7/1997 | Verrangia |
| D384,229 | S | 9/1997 | Verrangia |
| 5,688,125 | A | 11/1997 | Birdsong-Raffo |
| 5,720,396 | A | 2/1998 | Wegscheid et al. |
| 5,888,117 | A | 3/1999 | Sutton |
| 6,068,139 | A | 5/2000 | Brozak et al. |
| 6,204,896 | B1 | 3/2001 | Matsuhira et al. |
| 6,310,612 | B1 | 10/2001 | Kotsubo et al. |
| 6,665,965 | B1 | 12/2003 | Turchi et al. |
| 6,740,379 | B1 | 5/2004 | Congard et al. |
| 7,097,049 | B1 | 8/2006 | Singer et al. |
| 7,210,587 | B1 * | 5/2007 | Singer et al. ..... 211/55 |
| 7,290,365 | B1 | 11/2007 | Plutsky |
| 7,665,617 | B2 | 2/2010 | Shea |
| 7,992,330 | B2 | 8/2011 | DaRif et al. |
| 8,132,679 | B2 | 3/2012 | Berry et al. |
| 8,286,808 | B1 | 10/2012 | Setlik |
| 2005/0170151 | A1 | 8/2005 | Dobson et al. |
| 2005/0235530 | A1 | 10/2005 | Boisvert |
| 2008/0149279 | A1 | 6/2008 | Leighty et al. |
| 2012/0144708 | A1 | 6/2012 | Schwartz |
| 2012/0285915 | A1 | 11/2012 | O'Quinn et al. |
| 2012/0329011 | A1 | 12/2012 | Clark |
| 2013/0042511 | A1 | 2/2013 | Schwartz |
| 2013/0047478 | A1 | 2/2013 | Chang |

* cited by examiner

DISPLAY TOOL

RELATED APPLICATION

This application claims priority to provisional patent application U.S. Ser. No. 61/738,222 filed on Dec. 17, 2012, the entire contents of which is herein incorporated by reference.

BACKGROUND

The embodiments herein relate generally to devices that can display sheer material for window coverings.

Prior to embodiments of the disclosed invention, sampling devices or systems need to have a human to manually lift up the flap and hold it in an open position manually to show the fabric in the open position. The prior art includes U.S. Patent Application 2013/30042511 filed by Schwartz; U.S. Pat. No. 4,458,435 issued to Ackerman; U.S. Pat. No. 3,776,503 issued to Boden.

Schwartz offers an alternate solution to the same problem. Schwartz teaches that multiple swatches can be displayed by changing out swatches from a sign. The present invention teaches lifting the swatches in unison which is not found in Schwartz. Ackerman uses a book to insert swatches and teaches lifting each individual swatch manually, rather than using a covering to do so. Boden teaches a device which assists a user in making top hands, the device has a series of protrusions that can be raised and lowered manually much like Schwartz.

SUMMARY

A display tool is configured to maneuver a fabric swatch covering and includes a swatch deck and a support arm attached to a lifting tab to maneuver the lifting tab away from the swatch deck. A substrate is attached to the swatch deck and configured to support the support arm when the lifting tab is distant the swatch deck. A first swatch covering front side is attached to the support arm. A first plurality of support veins front side is attached to the first swatch covering back side and the first plurality of support veins back side is attached to the substrate. The support arm can be supported against the substrate to display the first swatch covering and the first plurality of support veins from the support arm.

In some embodiments, a second swatch covering comprising a second swatch covering front side and a second swatch covering back side. The second swatch covering front side is mechanically coupled to the support arm. A second plurality of support veins comprising a second plurality of support veins front side and a second plurality of support veins back side. The second plurality of support veins front side is attached to the second swatch covering back side and the second plurality of support veins back side is attached to the substrate. A third swatch covering comprising a third swatch covering front side and a third swatch covering back side. The third swatch covering front side is mechanically coupled to the support arm. A third plurality of support veins comprising a third plurality of support veins front side and a third plurality of support veins back side. The third plurality of support veins front side is attached to the third swatch covering back side and the third plurality of support veins back side is attached to the substrate.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
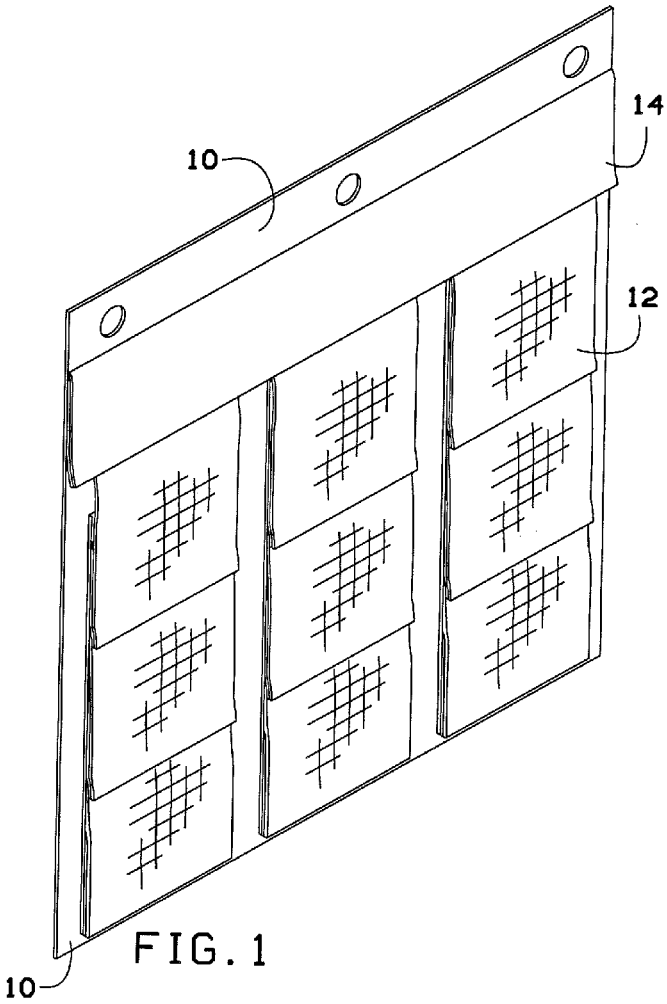
FIG. 1 is a perspective view of an embodiment of the invention in non-extended configuration.

By way of example, and referring to FIG. 1, one embodiment of the display tool comprises swatch deck 10 mechanically coupled to swatch covering 12. Swatch covering 12 can be displayed as shown in more detail in FIG. 2 and FIG. 3.

Figure 2:
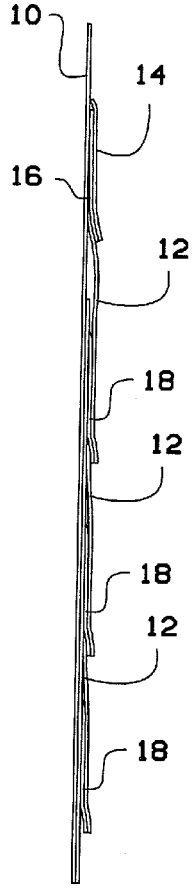
FIG. 2 is a side view of an embodiment of the invention in non-extended configuration.
Figure 3:
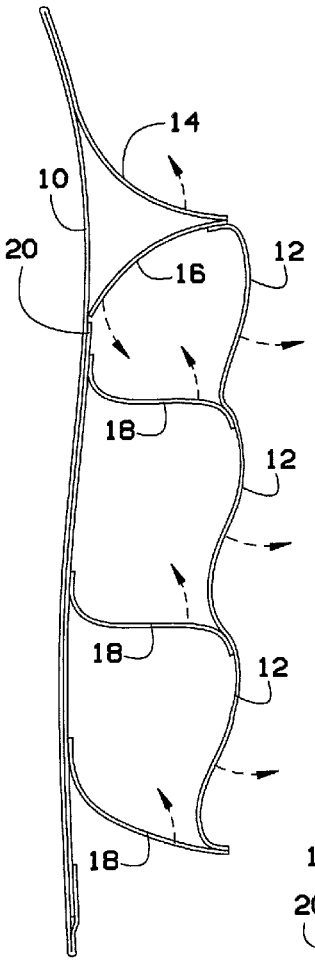
FIG. 3 is a side view of an embodiment of the invention in extended configuration.
Figure 4:
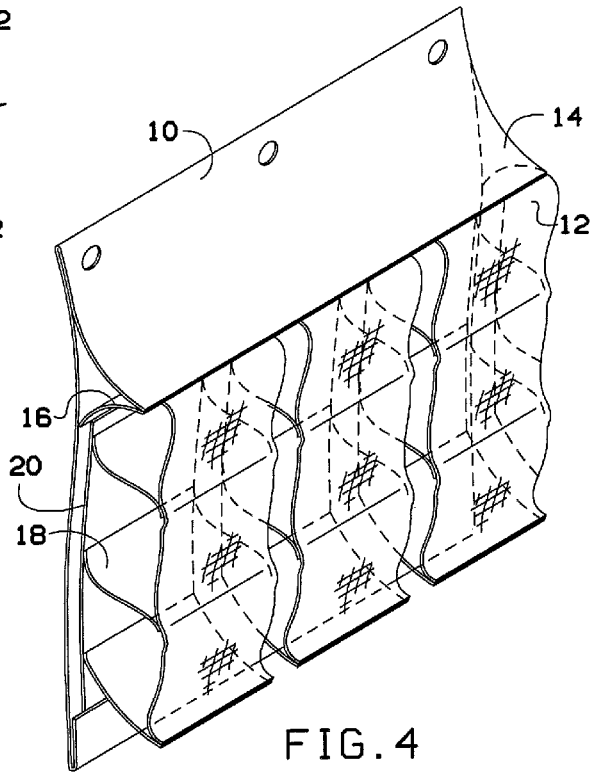
FIG. 4 is a perspective view of an embodiment of the invention in extended configuration.

As shown in FIG. 2 and FIG. 3, swatch deck 10 is mechanically coupled to substrate 20 and lifting tab 14. Lifting tab 14 has a lifting tab front end and a lifting tab back end. The lifting tab back end is mechanically coupled to support arm 16. Support arm 16 has a support arm top side which is mechanically coupled to the lifting tab back end and a support arm bottom side which is mechanically coupled to a first swatch covering 12. The first swatch covering 12 further has a first swatch covering back side and a first swatch covering front side.

Substrate 20 is further mechanically coupled to first support vein 18, second support vein 18 and proceeding to N support vein 18 collectively, a first plurality of support veins 18. Where N is the final support vein of a number that can be chosen by the user. First support vein 18 has a first support vein front side and a first support vein back side. The first support vein front side is mechanically coupled to a back side on the first swatch covering 12. In doing this support arm 16 is immediately adjacent to a substrate top. This causes the first swatch covering 12 to protrude outward and allows a user to easily display the substrate 20 and first support vein 18 which can be used to discern which fabric would make for the best window covering.

First support vein 18 has a first support vein back side which is mechanically couple to the first swatch covering back side. Likewise, there is a second support vein 18 comprising a second support vein front side which is mechanically couple to the first swatch covering back side and a second support vein back side. Additionally, there is a third support vein 18 comprising a third support vein front side which is mechanically couple to the first swatch covering back side and a third support vein back side. This pattern can continue to the user's desire with the N support vein being mechanically coupled to a back side of N−1 plurality of swatches 12. Collectively, the first plurality of support veins has first plurality of support veins front side and a first plurality of support veins backside.

In some embodiments there is a second swatch covering 12. Second swatch covering 12 is parallel to first swatch covering 12 and likewise possesses a second swatch covering front side and a second swatch covering back side. The second swatch covering front side is mechanically coupled to support arm 16. The second swatch covering back side is attached to second plurality of support veins 18. The second plurality of support veins 18, comprises a number of support veins 18 (as noted above) with a second plurality of support veins front side and a second plurality of support veins back side.

In some embodiments there is a third swatch covering 12. Third swatch covering 12 is parallel to first swatch covering 12 and likewise possesses a third swatch covering front side and a second swatch covering back side. The third swatch covering front side is mechanically coupled to support arm 16. The third swatch covering back side is attached to a third plurality of support veins 18. The third plurality of support veins 18, comprises a number of support veins 18 (as noted above) with a third plurality of support veins front side and a third plurality of support veins back side.

While embodiments of the present invention can be made in known materials in a known manner, the following construction has been effective. Swatch deck 10 can be die cut to any desired size. Lifting tab 14 and support arm 16 can likewise be die cut. Lifting tab 14 and support arm 16 can be two separate pieces joined with an adhesive or they can be a single piece with the same protrusion properties. Swatch coverings 12 are of the variety commonly used in this field, but sizes and shapes can vary. The substrate can be anything from a cardstock weight paper to a plastic depending on the usage desired. In some embodiments, swatch deck 10 can be perforated with holes to be placed in a binder or mounted to a wall.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A display tool configured to maneuver a fabric swatch covering, the display tool comprising:

a swatch deck directly attached to a lifting tab;

a support arm having a distal end that is directly attached to the lifting tab configured to maneuver the lifting tab distant the swatch deck;

a substrate directly attached to the swatch deck wherein a first mode of operation the support arm is immediately adjacent to the substrate at a proximate end and displaces the swatch deck from the substrate; and a first swatch covering comprising a first swatch covering front side and a first swatch covering back side; wherein the first swatch covering front side is mechanically coupled to the support arm;

a first plurality of support veins comprising a first plurality of support veins front side and a first plurality of support veins backside; wherein the first plurality of support veins front side is attached to the first swatch covering back side and the first plurality of support veins back side is attached to the substrate;

wherein the support arm can be supported against the substrate to display the first swatch covering and the first plurality of support veins from the support arm.

2. The display tool of claim 1, further comprising:

a second swatch covering comprising a second swatch covering front side and a second swatch covering back side; wherein the second swatch covering front side is mechanically coupled to the support arm; and a second plurality of support veins comprising a second plurality of support veins front side and a second plurality of support veins back side; wherein the second plurality of support veins front side is attached to the second swatch covering back side and the second plurality of support veins back side is attached to the substrate.

3. The display tool of claim 1, further comprising:

a second swatch covering comprising a second swatch covering front side and a second swatch covering back side; wherein the second swatch covering front side is mechanically coupled to the support arm; and a second plurality of support veins comprising a second plurality of support veins front side and a second plurality of support veins back side; wherein the second plurality of support veins front side is attached to the second swatch covering back side and the second plurality of support veins back side is attached to the substrate;

a third swatch covering comprising a third swatch covering front side and a third swatch covering back side; wherein the third swatch covering front side is mechanically coupled to the support arm; and a third plurality of support veins comprising a third plurality of support veins front side and a third plurality of support veins back side; wherein the third plurality of support veins front side is attached to the third swatch covering back side and the third plurality of support veins back side is attached to the substrate.

* * * * *